United States Patent [19]

Thornton

[11] Patent Number: 5,071,620

[45] Date of Patent: Dec. 10, 1991

[54] HIGH CREEP STRENGTH ZINC ALLOYS

[75] Inventor: Cedric H. Thornton, Oxfordshire, England

[73] Assignee: International Lead Zinc Research Organization, Inc., Research Triangle Park, N.C.

[21] Appl. No.: 576,352

[22] Filed: Aug. 31, 1990

[51] Int. Cl.[5] ..... C22C 18/04

[52] U.S. Cl. ..... 420/514; 420/515; 420/516; 420/518; 420/519; 148/441

[58] Field of Search ..... 420/514–520; 148/441

[56] References Cited

U.S. PATENT DOCUMENTS 1,767,011 6/1930 Pack et al. ..... 420/518

FOREIGN PATENT DOCUMENTS 198585 7/1958 Austria ..... 420/519
775207 5/1972 Belgium ..... 420/516
335270 9/1936 Italy ..... 420/519
67297 1/1944 Norway ..... 420/516

*Primary Examiner*—R. Dean
*Assistant Examiner*—George Wyszomierski
*Attorney, Agent, or Firm*—Brumbaugh, Graves, Donohue & Raymond

[57] ABSTRACT

A zinc/low aluminum alloy with lithium additions demonstrating improved creep resistance and suitable for hot chamber pressure die casting. The alloy preferably contains from about 0.1–2% Al, 0.07–0.19% Li, the balance zinc. The alloy also may contain Cu, Mn and Mg.

8 Claims, No Drawings

HIGH CREEP STRENGTH ZINC ALLOYS

BACKGROUND OF THE INVENTION

The present invention is directed to an improved zinc alloy, and in particular a zinc alloy suitable for hot chamber zinc die casting.

Hot chamber pressure die casting is generally preferred to the cold chamber method since it is far more productive and hence less costly than the cold chamber method. On the other hand, certain alloys, e.g. aluminum alloys, can only be die cast by the cold chamber method since they react with and degrade the materials of the die casting apparatus at temperatures used to hold them in their liquid state. When the mechanical properties of the alloy, e.g. creep resistance, are more important than cost, these alloys may be employed albeit by the cold chamber method.

Alloy compositions presently in use for hot chamber die casting include Zn/Al alloys containing about 4% Al. For example, a commercially available alloy is ZAMAK 5, which contains approximately 4% Al, 1.0% Cu, 0.04% Mg, the balance Zn. (All percentages are by weight.) The addition of Al to such alloys, however, causes the creep strength to degrade as the Al content exceeds about 1%.

Another alloy, ILZRO 16 (1.0–1.5% Cu; 0.15–0.25% Ti; 0.1–0.2% Cr; 0.01–0.04% Al; balance Zn) demonstrates high creep strength (presumably due to Ti-Cr-Zn precipitates) but is suitable only for cold chamber die casting.

It is, therefore, an object of the present invention to provide an alloy composition which is both suitable for hot chamber pressure die casting and has improved creep strength.

SUMMARY OF THE INVENTION

According to the invention, it has been found that the addition of Li to Zn/low Al compositions improved the creep strength of the alloy while still providing an alloy suitable for hot chamber die casting.

While it has not been confirmed, it is believed that creep strength is improved with respect to Zn alloys when the alloy comprises a finely dispersed precipitated intermetallic second phase of one or more metals as opposed to a true solid solution. The addition of Li to the Zn/Al alloy may increase the number of fine precipitated second phase particles and improve their dispersion in the zinc alloy.

DESCRIPTION OF THE PREFERRED EMBODIMENTS

Additions of Li to a nominal 0.3% level were made to base Zn/Al compositions.

Melts were made up using 99.9% Zn ingots and hardener alloys for the elements Al, Cu, Mn and Mg.

Li additions were introduced to the melt in elemental form to provide a family of alloys containing nominal Li concentrations of 0.1, 0.2 and 0.3%.

The compositions of the alloys investigated are given in Table 1.

TABLE 1

| | Alloy Compositions | | | | |
|---|---|---|---|---|---|
| Alloy | % Cu | % Al | % Mn | % Mg | % Li |
| CEC* | 1.8 | 4.1 | — | 0.04 | — |
| CED | 1.3 | 0.31 | 0.31 | 0.01 | — |
| CEF 1 | 1.3 | 0.3 | 0.31 | 0.015 | 0.07 |

TABLE 1-continued

| | Alloy Compositions | | | | |
|---|---|---|---|---|---|
| Alloy | % Cu | % Al | % Mn | % Mg | % Li |
| CEF 2 | 1.3 | 0.3 | 0.3 | 0.019 | 0.13 |
| CEF 3 | 1.3 | 0.32 | 0.3 | 0.013 | 0.19 |

*ZAMAK 5-type alloy for comparison.

Test samples were produced by a die which provided 2 tensile specimens, 2 creep specimens and 2 impact specimens from each shot. The die temperature was approximately 105° C. at the start of a casting run. Liquid metal was introduced to the machine at a temperature of 440° to 460° C. A cooling rate typical of that of pressure die castings, that is, in excess of 300° C./sec was experienced by the castings. The machine operating conditions were kept constant for each of the alloys.

In as-cast material, Li was segregated to the grain boundaries and was also found in discrete particles. Li was not associated with Al, Cu, Mg or Mn, suggesting that the Li-containing phases formed were of the type Li-Zn.

After aging at 100° C. the Li was homogenized, the distribution of Li more uniform and precipitation had occurred within the grains.

The tensile properties, impact strength and hardness of the diecast alloys are given in Tables 2 and 3 for the as-cast condition and for samples as-cast and aged 200 h at 100° C. respectively. Increasing the Li concentration resulted in increased tensile strength and hardness.

In the as-cast condition, the tensile strength of the alloys was generally some 75 to 85% of that of the alloy used for comparison. By ageing for 200 h at 100° C. the Li-containing alloys showed improved tensile strength but were of similar hardness compared with the un-aged materials.

Impact strength and percentage elongation were minimal compared with the ZAMAK 5-type alloy and were not significantly influenced by the ageing treatment.

The minimum secondary creep rates for the Li containing alloys are given in Table 4 for 100° C. tests at a stress level of 50N/mm$^2$. In the Table, a comparison is made with values for several other zinc alloys under similar test conditions. The figures show the Li-containing alloys have significantly improved creep resistance compared with ZAMAK 5 with the creep properties intermediate between ZAMAK 5 and ILZRO 16.

TABLE 2

| | As-cast Mechanical Properties of the Zinc Alloys | | | |
|---|---|---|---|---|
| Alloy | Tensile Strength N/mm$^2$ | Elong. % (50 mm) | Hardness HV10 | Impact Strength J |
| CEC | 305 | 1 | 132 | 25.3 |
| CED | 227 | 0 | 117 | 2.3 |
| CEF 1 | 178 | 0 | 132 | 2.3 |
| CEF 2 | 248 | 0 | 152 | 3.3 |
| CEF 3 | 264 | 0 | 167 | 2.7 |

TABLE 3

| | Mechanical properties of the Zinc Alloys Aged 200 h at 100° C. | | | |
|---|---|---|---|---|
| Alloy | Tensile Strength N/mm$^2$ | Elong. % (50 mm) | Hardness HV10 | Impact Strength J |
| CEC | — | — | 103 | 9.7 |
| CED | 222 | 0 | 100 | 2.3 |

TABLE 3-continued

| Alloy | Mechanical properties of the Zinc Alloys Aged 200 h at 100° C. Tensile Strength N/mm² | Elong. % (50 mm) | Hardness HV10 | Impact Strength J |
|---|---|---|---|---|
| CEF 1 | 249 | 0 | 129 | 2 |
| CEF 2 | 278 | 0 | 144 | 2.7 |
| CEF 3 | 319 | 0 | 161 | 2.3 |

TABLE 4

| Alloy | % Li | Creep Resistance Applied Stress N/mm² | psi | Test Duration Hr. | Measured Elongation % | Time to 1% Creep Strain (Hrs.) | Secondary Creep Rate (1%/10,000 Hr.) |
|---|---|---|---|---|---|---|---|
| CED | 0 | 50 | 7250 | 193 | 1.9 | 73 | 89.1 |
| CEF 1 | 0.07 | 50 | 7250 | 186 | 2.97 | 57 | 101.2 |
| CEF 2 | 0.13 | 50 | 7250 | 280 | 1.83 | 93 | 36.6 |
| CEF 3 | 0.19 | 50 | 7250 | 643 | 2.97 | 167 | 28.2 |
| CEC | ZAMAK 5 | 50 | 7250 | 26 | 9.3 | 5.9 | 2300 |
| | ILZRO 16 | 50 | 7250 | 38,000 | 1.0 | 37,500 | 0.2 |

NOTE: ILZRO 16 is a 95° C. test. All other data are for 100° C.

From the above, it can be seen that while the addition of Li appears to lower the creep resistance at lower concentrations (e.g. 0.07%), the creep resistance improves with increased Li addition. This apparent inconsistency is not completely understood and it is therefore contemplated that Li additions of from about 0.03–0.6% Li will yield improved creep resistance in Zn/low Al (e.g. 0.1–2.0% Al) alloys. Concentrations of from about 0.1–0.6% Li are, however, preferred. Rapid cooling, e.g., at least 300° C./sec, may be necessary to obtain sufficiently dispersed Li in the higher concentrations.

Al in a concentration of from about 0.1–2.0% is contemplated with an Al concentration of 0.3–1.5% being preferred.

Cu may be added up to about 2.5% to improve tensile strength and hardness. A Cu content of 0.15–2.5% is preferred.

Mn may be added up to 0.5% with 0.3% being preferred.

From about 0.005–0.3% Mg may be added.

It is also within the scope of the invention that the Li-containing alloy demonstrate improved creep resistance while at the same time being compatible with hot chamber pressure die casting. A creep resistance measured at 100° C. and 50N/mm² of at least 50 hours to 1% creep strain is preferred.

I claim:

1. An alloy composition consisting essentially of from about 0.1–2.0% Al, 0.07–0.19% Li, the balance Zn said alloy demonstrating a creep resistance of at least 50 hours to 1% creep strain elongation at 50 N/mm² and 100° C.

2. An alloy composition according to claim 1 further containing up to about 2.5% Cu.

3. An alloy composition according to claim 2 further containing up to about 0.5% Mn.

4. An alloy composition according to claim 3 further containing from about 0.005–0.3% Mg.

5. An alloy composition according to claim 2 further containing from about 0.005–0.3% Mg.

6. An alloy composition according to claim 1 wherein the Al content is from about 0.3–1.5%.

7. An alloy composition according to claim 6 containing Cu in a concentration of from about 0.15–2.5%.

8. An alloy composition according to claim 1, said alloy further being suitable for casting by hot chamber pressure die casting.

* * * * *